United States Patent [19]

Drago et al.

[11] 4,221,322

[45] Sep. 9, 1980

[54] TUBE GUIDE INSERT AND CONSTRAINT FITTINGS FOR COMPENSATING ROTOR

[75] Inventors: James A. Drago, Brewster; Steven R. Savitz, Astoria, both of N.Y.

[73] Assignee: Union Carbide Corporation, New York, N.Y.

[21] Appl. No.: 847,174

[22] Filed: Oct. 31, 1977

[51] Int. Cl.[2] ..... B04B 9/08

[52] U.S. Cl. ..... 233/23 R; 233/1 R

[58] Field of Search ..... 233/23 R, 24, 25, 26, 233/14 R, 1 R, 22; 74/660, 797; 174/86; 339/5 R, 5 A, 103

[56] References Cited

U.S. PATENT DOCUMENTS

| | | | |
|---|---|---|---|
| 2,135,835 | 11/1938 | Papello | 339/5 R |
| 2,666,188 | 1/1954 | Klein | 174/86 X |
| 3,347,454 | 10/1967 | Bellamy et al. | 233/14 R |
| 3,358,072 | 12/1967 | Wrench | 74/660 X |
| 3,986,442 | 10/1976 | Khoja et al. | 233/14 R |
| 4,056,224 | 11/1977 | Lola chi | 233/14 R |

FOREIGN PATENT DOCUMENTS

| | | | |
|---|---|---|---|
| 21729 | of 1905 | United Kingdom | 339/5 A |

*Primary Examiner*—George H. Krizmanich
*Attorney, Agent, or Firm*—Frederick J. McCarthy, Jr.

[57] ABSTRACT

A 2:1 compensating rotor is used in a continuous-flow centrifuge system, thereby allowing the dynamic loading and unloading of biological suspensions and processing solutions in a "closed" fashion without resort to rotary seals. Improved performance is obtained by relieving the mechanical stresses associated with the 2:1 relative motion between rotary components. In zones of high flexural and torsional stress low-friction bearing mounted tube constraint fittings are utilized to minimize tubing loop wear and risk of rupture. Similarly, in regions of high centrifugal force a tube guide insert is utilized to separate and constrain the discrete fluid-carrying tubes, thereby minimizing abrasion induced by the relative motion between the discrete tubes, as well as minimizing abrasion induced by the relative motion between the discrete tubes and the inner walls of the tube guide assembly.

9 Claims, 9 Drawing Figures

TUBE GUIDE INSERT AND CONSTRAINT FITTINGS FOR COMPENSATING ROTOR

BACKGROUND OF THE INVENTION

This invention relates to improvements in continuous-flow centrifuge systems. In particular, it relates to improvements in the mechanical design of conventional compensating rotors utilized in continuous-flow centrifuge systems.

The application of centrifugal force is widely used in the processing of blood and other biological suspensions. It provides a convenient means for sorting and classifying particulates on the basis of buoyant density differences and for retaining particles subjected to opposing hydrodynamic forces. An illustrative example of such usage is the continuous-flow washing technique for the deglycerolization of red blood cells.

Glycerol behaves as a cryoprotective agent, permitting the freezing and frozen storage of the red cell with minimal freeze-related damage. The concentrations of glycerol necessary to achieve this protective effect (viz., 20–40%), however, are not well tolerated by humans and the protectant must be removed from the thawed unit prior to infusion. This "washing" procedure may be accomplished either manually or by using one of several automated systems currently available.

Manual methods consist of an alternating sequence of saline dilution, centrifugal separation and supernatant expression. The technique is labor intensive and the quality of the product varies with the skills of the technician.

Commercial cell washing systems seek to reduce processing time per unit by half (to about 30 minutes) and improve quality consistency via automated centrifugation. The IBM system, for example, is an automated version of the discontinuous, batch-wise manual technique. Other illustrations are found in "flow-through" centrifuges, such as those marketed by Fenwal and Haemonetics, where centrifugal force is employed to retain the red cell mass in the periphery of a processing container spinning at 3000–4000 rpm while saline solutions of decreasing tonicity are passed continuously through cells at about 150–200 ml/min. in a direction countercurrent to the centrifugal field. In all these cases, the fluid exchange is effected in a more or less aseptic fashion by means of a rotary seal.

There are several disdvantages associated with the rotary seal arrangement in blood processing applications. The possibility of contaminants passing between the seal faces exists. Consisting, as it does, of an assembly of precisely machined components of specialty materials, the seal represents a major contribution to the fabrication and quality control costs of the blood processing container, which is designed to be a disposable item. In addition, the seal may impose flow limitations, and high shear rates at the seal juncture may damage the more labile blood components.

A recent advance in centrifugal apparatus development allows continuous flow blood processing without rotary seals. The "compensating rotor" is a mechanical device which permits the exchange of fluids between a stationary and rotating container via an integral tubing loop. The absence of the seal eliminates the contamination risk and permits substantially increased flow rates (>1 liter/min.) with a corresponding reduction in processing time per unit of cells washed. Such an apparatus is useful not only in deglycerolization but also in various other modes of centrifugal blood processing, including component separation and pheresis applications.

The effect of the 2:1 relative rotation utilized in the operation of conventional twist compensating devices is well known in the art. One illustration of the application of this principle is the apparatus described in U.S. Pat. No. 3,586,413.

The N.I.H. blood centrifuge of the type described in the article by Y. Ito, et. al, "New Flow-Through Centrifuge Without Rotating Seals Applied to Plasmapheresis," Science 189, p. 999 (1975), employs 2:1 rotation to effect fluid transfer into a rotating processing container. Similarly, the same principle is utilized in the centrifugal liquid processing system disclosed in U.S. Pat. No. 3,986,442.

Although the conventional compensating rotor obviates certain problems associated with the earlier rotary seal systems, it possesses several disadvantages at typical operating speeds, which limit its effective use in the exchange of fluids between a stationary and rotating container. As a result of the 2:1 relative motion between the rotary components, and the associated mechanical stresses on the tubing loop, the effective lifetime of the fluid-carrying tubing loop is reduced considerably. Generally, this problem manifests itself in one of several possible ways.

One occurrence, of particular significance, relates to stress-related tubing loop failures, especially in regions of high flexural and torsional stress. These failures, which are associated with the untwisting process, are most severe in the center spindle and centrifuge cover areas of the compensating rotor.

In addition, when the tubing loop consists of discrete tubes which are used for fluid flow into and out of the rotating processing container, there is a tendency for the tubes to abrade one another in the regions of high centrifugal force, immediately above and below the rigid tube guide affixed to the rotating frame, where they are in close contact with one another. As indicated by Ito, the counterrotation of the tube guide facilitates the untwisting process of the rotor; however, the effective transfer of this contrarotary motion to the tubing loop depends on maintaining a good fit between the outer walls of the tubes and the inner surface of the guide through which the tubes pass. Furthermore, an improper fit between the inner surface of the tube guide and the exterior walls of the tubes may lead to slippage, causing excessive twisting or kinking of the tubes, particularly when thin walled tubing is used.

It is apparent that the major limitation of the conventional compensating rotor is its vulnerability at high rotational speeds, due to the 2:1 relative motion between the rotary components, and the associated mechanical stresses on the tubing loop. Since operating speeds of 3000–4000 rpm are required for effective and economical processing of blood, this is a significant limitation. The need for a continuous-flow centrifuge system capable of operating at 3000–4000 rpm is especially acute in the blood processing industry.

Accordingly, it is an object of the invention to provide an improved compensating rotor for use in a continuous-flow centrifugation system. More specifically, it is an object of the invention to overcome the aforementioned difficulties by providing means to relieve the mechanical stresses inherent in the operation of the conventional compensating rotor.

It is a further object of the invention to provide improved tube constraint fittings which constrain the lower central and upper central tubing loop segments in the areas of the center spindle and centrifuge cover, respectively, in such a manner as to minimize tubing wear and risk of rupture due to flexural fatigue.

It is still a further object of the invention to provide a novel tube guide insert with parallel channels which separate and constrain the peripheral segment of the tubing loop in such a manner as to minimize tubing abrasion and slippage due to centrifugal force.

SUMMARY OF THE INVENTION

The foregoing and other objects and advantages which will be apparent in the following detailed description of the preferred embodiment, or in the practice of the invention, are achieved by the invention disclosed herein, which generally may be characterized as an improved compensating rotor for a continuous-flow centrifuge system, the improvement comprising:

(1) means for constraining the lower central segment of the tubing loop in the region of the center spindle;

(2) means for separating and constraining the peripheral segment of the tubing loop within the tube guide; and (3) means for constraining the upper central segment of the tubing loop in the region of the centrifuge cover.

DETAILED DESCRIPTION OF PREFERRED EMBODIMENTS

In order to afford a complete understanding of the invention and an appreciation of its advantages, a description of a preferred embodiment in a typical operating environment is presented below.

Figure 1:
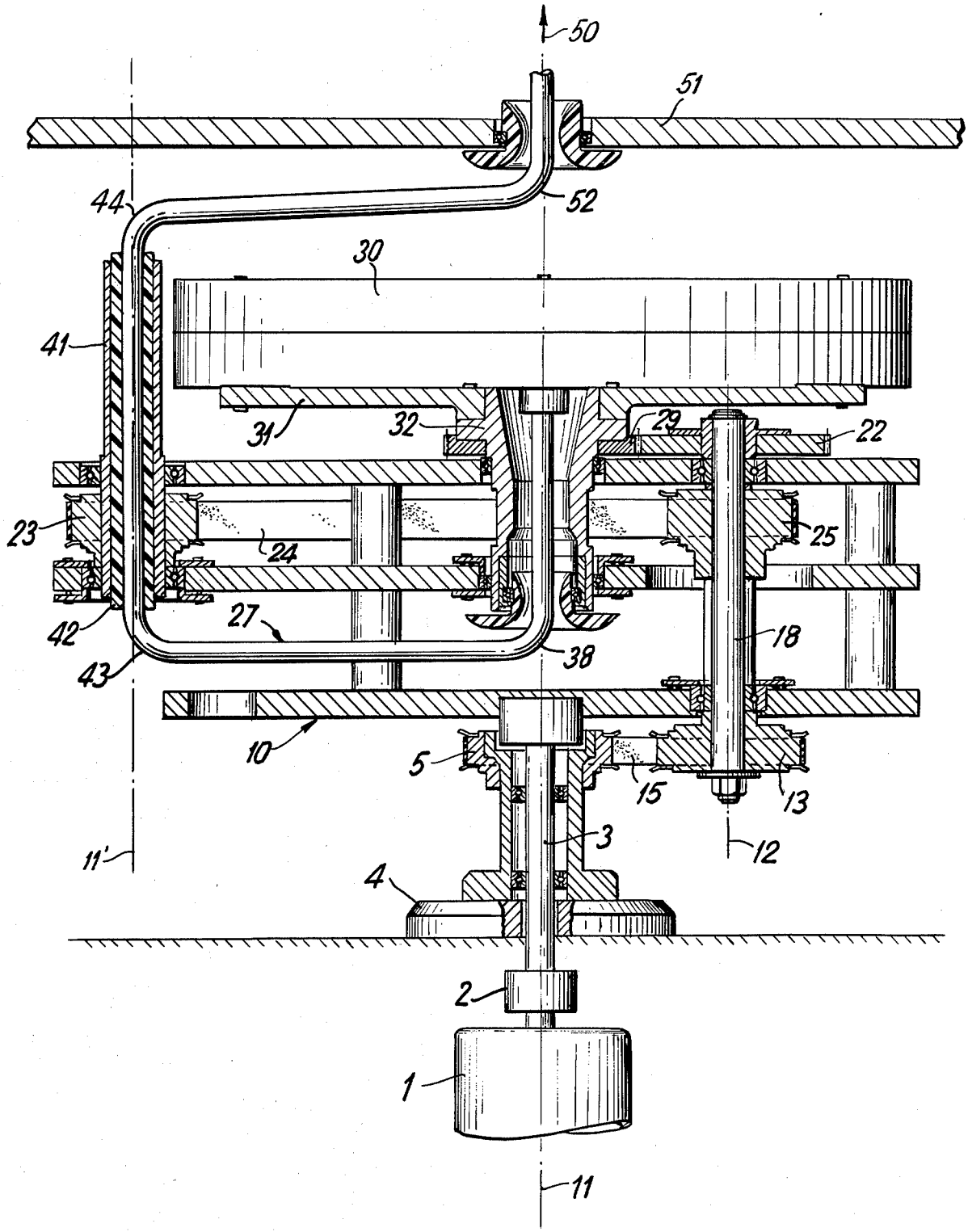
FIG. 1 is a sectional view of the major components of a compensating rotor.

To better understand and appreciate the present invention and its advantages, it is helpful to understand in general, the structure and operation of the compensating rotor illustrated in FIG. 1.

Referring now to FIG. 1, a stacked frame assembly 10 is caused to revolve at rotational speed w about a central vertical axis 11 by means of a drive shaft 3 linked to a speed-controlled motor 1. A stationary timing pulley 5, affixed to the drive housing 4, serves to rotate a like pulley 13 about its own axis 12, at the same rotational speed as that of the frame 10 but in the opposite directional sense, this motion being communicated via timing belt 15. A jack shaft 18 transfers this secondary rotation to a spur gear 22 which, in turn, engages a like gear 29 affixed, via a hollow center spindle 32, to the container support 31. The 1:1 gearing arrangement causes the centrifugal processing container 30 and container support 31 to revolve at rotation speed 2w in the same directional sense as the frame 10 about the central vertical axis 11.

A flexible tubing loop 27 connects the centrifugal processing container 30 with a stationary source of fluid supply 50, located above the centrifuge cover 51. The tubing loop 27 passes through the center spindle 32 rotating at speed 2w, out around the periphery of the centrifugal processing container 30 and up through the centrifuge cover 51. While the centrifugal processing container 30 is rotating at speed 2w, the tubing path thus formed is constrained to revolve at speed w relative to the central vertical axis 11 by virtue of its passing through a tube guide 41 mounted on the rotating frame 10, the rotational axis 11' of the tube guide 41 being essentially parallel to that of the central vertical axis 11 of frame 10 and centrifugal processing container 30. The untwisting, or "twist-compensating" effect of this 2:1 relative motion has the following basis. For every revolution of the centrifugal processing container 30, a single twist is imparted to the tubing loop 27. Every revolution of the tube guide 41 imparts two twists in the opposite sense, one each in the tubing loop sections 43, 44 above and below the tube guide 41. Since the tube guide 41 is affixed to the frame 10 revolving at half the speed of the centrifugal processing container 30, each half-revolution of the tube guide 41 effectively removes the twist-imparted by every full revolution of the centrifugal processing container 30.

Although the compensating rotor prevents tubing twist, the geometry and kinematics of the system requires the tubing loop 27 to undergo a series of rather abrupt changes in directionality, particularly in the areas of the center spindle 32, the tube guide 41, and the centrifuge cover 51. These regions 38, 43, 44, 52, correspond to the lower central, peripheral and upper central segments of the tubing loop 27 in which the flexural motion induced by the untwisting process is most severe. The stress on the tubing loop 27 in these areas is amplified by the centrifugal force generated by driving the rotor assembly at speeds necessary for effective blood processing, typically at a centrifugal processing container speed of 3000 rpm. The peripheral portion of the tubing loop 27, revolving at 1500 rpm, experiences a relative centrifugal force in excess of 500 g's. While the tube guide 41 constrains the section of tubing which it encloses, the intervening sections, between the central vertical axis 11 and the tube guide 41 are constrained solely by fittings located in the centrifuge cover 51 and the center spindle 32. Conventionally, these fittings consist of spherical bearings through which the tubing loop 27 is made to pass.

Figure 2:
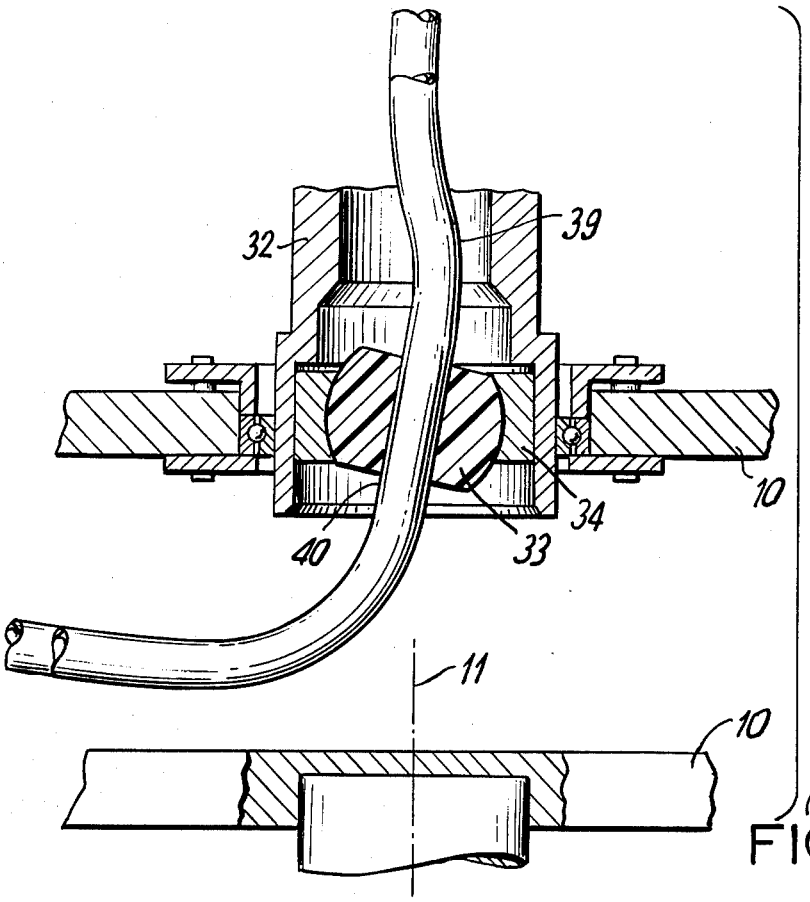
(PRIOR ART) FIG. 2
FIG. 2 is a sectional view of a conventional spherical bearing arrangement.

As illustrated in FIG. 2, a conventional spherical bearing consists of a truncated sphere 33 located in a retaining race 34 within which the truncated sphere 33 is free to rotate, much in the same manner as in a conventional bearing. In addition, some degree of axial reorientation is also permitted, usually not exceeding 30°. When placed in the center spindle 32, the spherical bearing constrains the tubing loop 27 as it exits the center spindle. The outer bearing retaining race revolves at 2w with the hollow center spindle 32, and the axis of rotation of the truncated sphere 33 reorients itself in response to the tension applied by the revolving tubing loop 27. Several limitations characterize such use of a conventional spherical bearing. The degree of axial freedom of the centrally positioned bearing does not approach the angle of choice (45°) for exiting the center spindle 32 and accommodating the 90° bend caused by the radial force on the tubing loop 27. The portion 39 of tubing loop 27 directly above the conventional spherical bearing is also diverted from the central vertical axis 11 of the center spindle 32, thus increasing the likelihood of kinking. The additional inertia of the steel sphere restricts the freedom of motion of the tubing loop 27 and increases the flexural work energy expenditure. In addition, the remaining stress components are concentrated in a short section 40 of the tubing loop 27 directly below the truncated sphere 33. An analogous situation exists in area 52 of the centrifuge cover 51 where spherical bearings are also conventionally employed. The above factors combine to limit the lifetime of the tubing loop 27 at rotor speeds useful for blood processing (typically about 3000 rpm), particularly when tubing of greater than 1/16" I.D. is used, since the greater the diameter and wall thickness of the tube, the greater the flexural work energy expenditure for untwisting.

Figure 3:
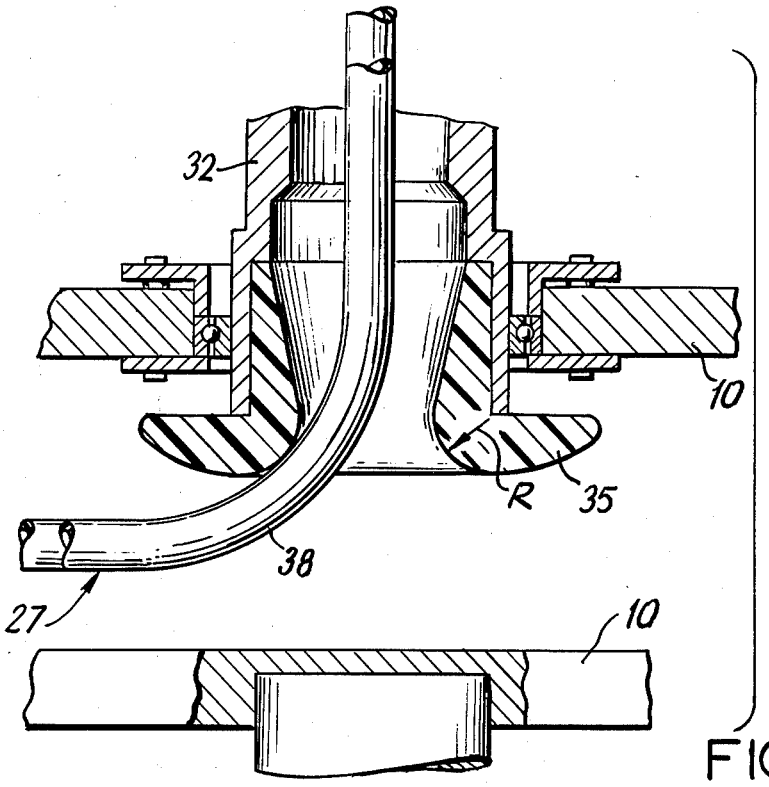
FIG. 3 is a sectional view of a low-friction tube constraint fitting pressed into the center spindle, in accordance with the present invention.

An improved tube constraint fitting is illustrated in FIG. 3. It consists of a smoothly contoured cylindrical plug of a suitable low-friction material, which constrains the lower central segment of the tubing loop 27 in the area 38 of the center spindle 32, in such a manner as to minimize tubing loop wear and risk of rupture due to flexural fatigue, thereby circumventing the inherent disadvantages associated with conventional spherical bearings, while at the same time achieving structural simplicity.

Referring now to FIG. 3, the improved tube constraint fitting 35 consists of a cylinder which has been suitably bored to permit passage of the tubing loop 27. A smooth radius (R) is machined from the interior and lower surfaces of the hollow cylinder. The tubing bend conforms to this radius and the tube is constrained along the zone of its contact with the fitting 35. Consequently, the flexural stresses are uniformly distributed along the contact zone, rather than concentrated in a single locus, as in the case of the spherical bearing. The dimensions of the fitting 35 are largely determined by the dimensions of the rotary system of which it is part. A diameter of one to six inches may be considered typical, with a radius of curvature of ½ to 3 inches. The larger radius of curvature practical, within the geometric constraints of the compensating rotor, is to be preferred. Poly-tetra fluorethylene, e.g. Teflon, is the preferred material for the improved tube constraint fitting 35, however, any self-lubricating or low friction material, e.g. polypropylene, high density polyethylene, or nylon, may be used to advantage.

Figure 4:
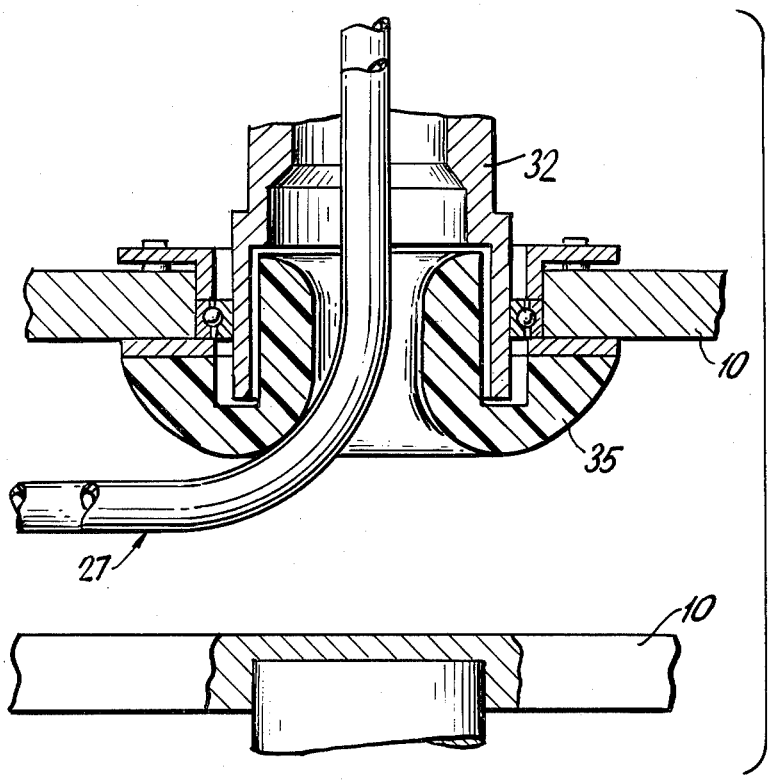
FIG. 4 is a sectional view of a low-friction tube constraint fitting secured to the rotating frame, in accordance with the present invention.
Figure 5:
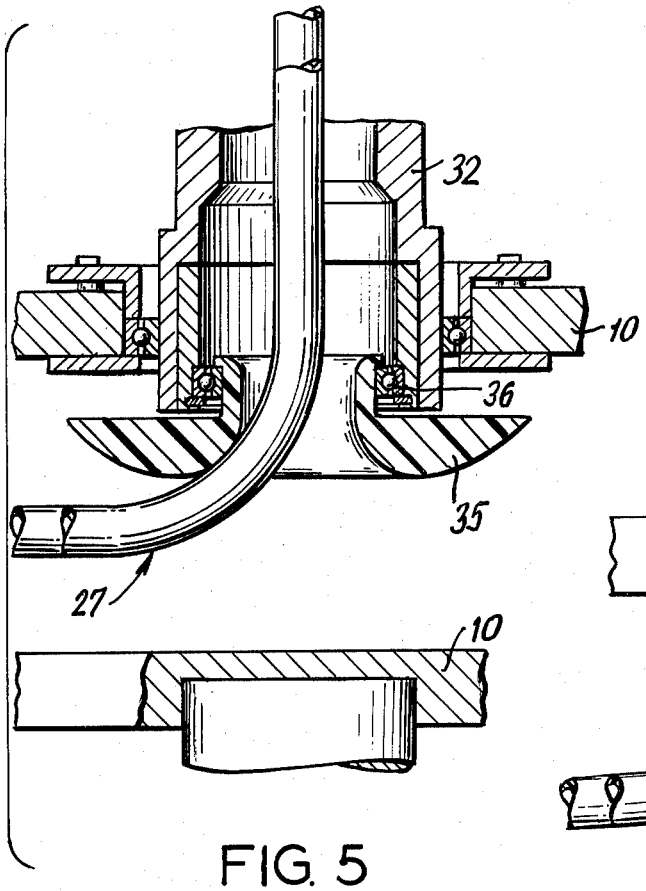
FIG. 5 is a sectional view of a preferred embodiment of a low-friction tube constraint fitting mounted within a bearing pressed into the center spindle, in accordance with the present invention.

The low-friction tube constraint fitting 35 may be mounted in one of several configurations. It may be pressed into the center spindle 32, as shown in FIG. 3, in which case it rotates at 2w, or at the speed of w relative to the tubing loop 27, which is revolving at half the speed of the center spindle 32. Alternately, the tube constraint fitting 35 may be secured to the rotating frame 10, as shown in FIG. 4, which revolves in synchronism with the tubing loop 27. In this case, the relative motion between the tubing loop 27 and the surface of the tube constraint fitting arises from the axial rotation of the tubing loop 27 due to its flexural motion. The preferred method, however, consists of mounting the tube constraint fitting 35 within a bearing 36 pressed into the center spindle 32 as shown in FIG. 5. The tube constraint fitting 35 is thus free to rotate at a speed determined by the combination of the differential rotation of the center spindle 32 and the tubing loop 27 and the axial rotation of the tubing loop 27. This "self-seeking" feature, taken together with the proper material selection, effectively minimizes frictional heating due to relative motion between the tube constraint fitting 35 and the tubing loop 27.

Figure 6:
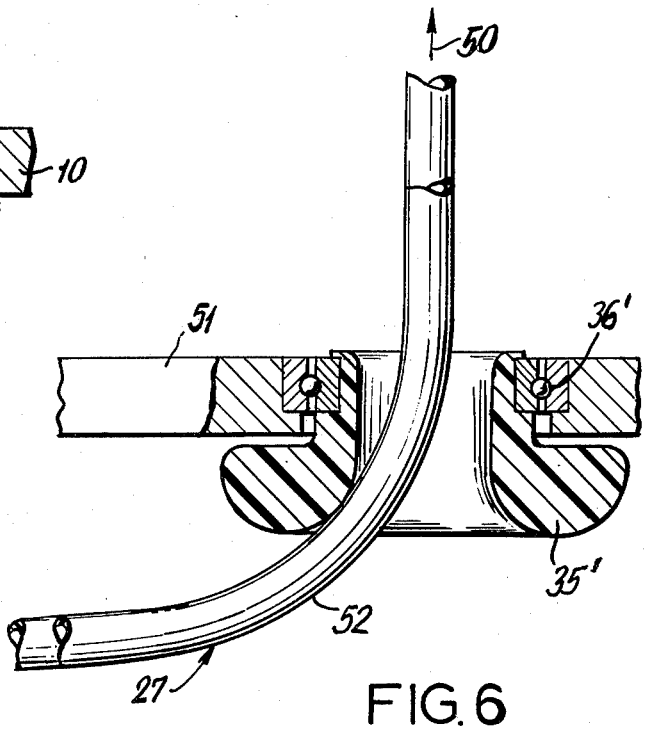
FIG. 6 is a sectional view of a preferred embodiment of a low-friction tube constraint fitting mounted within a bearing pressed into the centrifuge cover, in accordance with the present invention.

Referring to FIG. 6, it has been found that the same constraining technique, as utilized in the area of the center spindle, provides an effective means for constraining the upper central segment 52 of the tubing loop 27 in the region of the centrifuge cover 51. As shown, an improved low-friction tube constraint fitting 35' mounted within a bearing 36' pressed into the centrifuge cover 51 is the preferred method of constraining the upper central segment of the tubing loop in the area 52 of the centrifuge cover 51, in such a manner as to minimize tubing loop wear and risk of rupture due to flexural fatigue.

Referring again to FIG. 1, it is essential that the tubing loop 27 be adequately constrained in peripheral regions of high flexural and tensile loading. This constraint is conventionally accomplished by the inclusion of a rigid tube guide 41 mounted on the rotating frame 10. This tube guide 41 may be freely mounted in a pair of bearings (not shown) or may be actively driven at speed −w about its own axis by means of a pulley/belt arrangement 23-25. In either case, an abrading problem is encountered.

Whereas the removal of certain stresses provides the improvements in the lower central and upper central tubing loop segments 38, 52, it has been found that an alternate approach is productive in the peripheral segment of the tubing loop 43, 44. Thus as shown in FIG. 7, a novel tube guide insert 42 is utilized to confine the discrete tubes 27', 27" of the tubing loop 27 to separate channels in a spaced-apart relationship, thereby precluding their abrading and twisting upon one another, as well as the inner walls of the tube guide 41.

Figure 7:
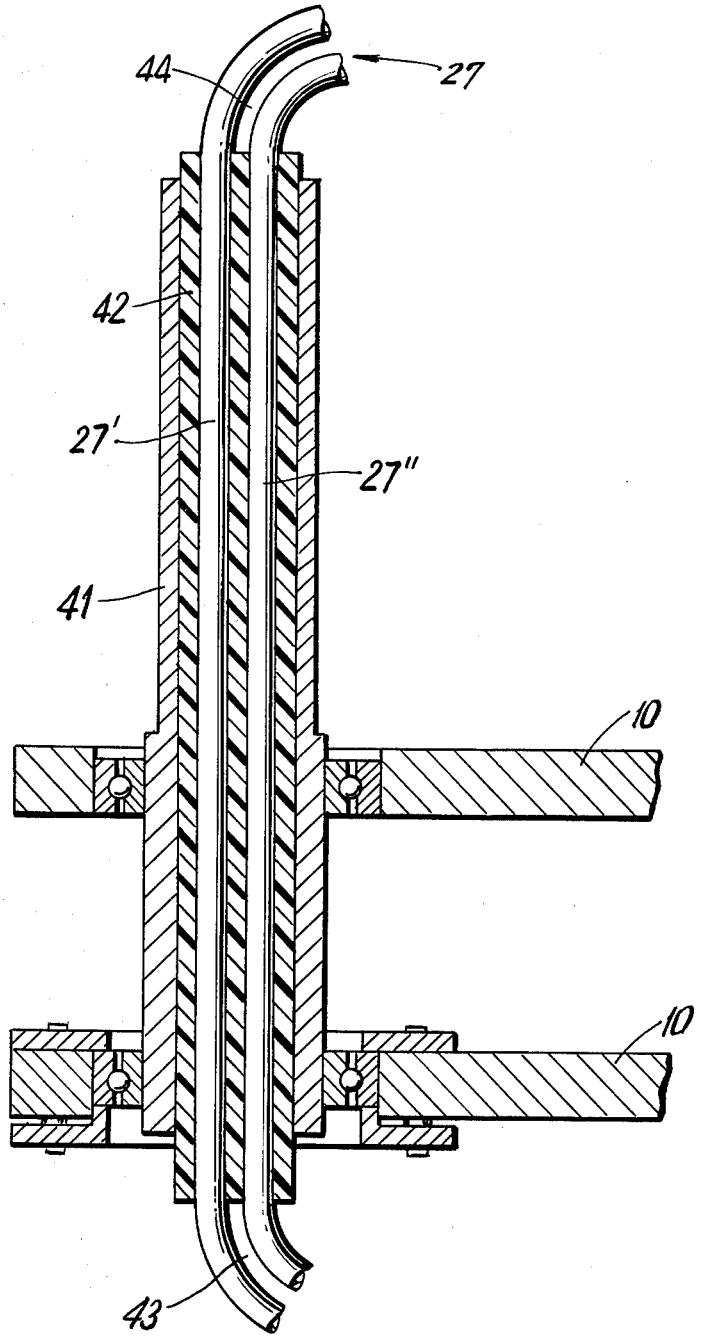
FIG. 7 is a sectional view of a tube guide insert, in accordance with the present invention.

Referring now to FIG. 7, the tube guide insert 42 consists of a solid cylinder of a rigid polymeric or other structural material into which a set of parallel channels or holes has been either machined or molded. The diameter of the insert is determined by that of the tube guide 41 and the length is chosen to provide a uniform curvature to the rotating tubing loop 27. The channels, one for each of the discrete tubes 27', 27", traverse the length of the tube guide 41 and are of a diameter substantially equal that of the tubing O.D., thereby facilitating a frictional fit. The cylinder may be inserted into the tube guide 41 and secured either by a press fit or by alternate fastening means, e.g. set screws or the like.

Figure 8:
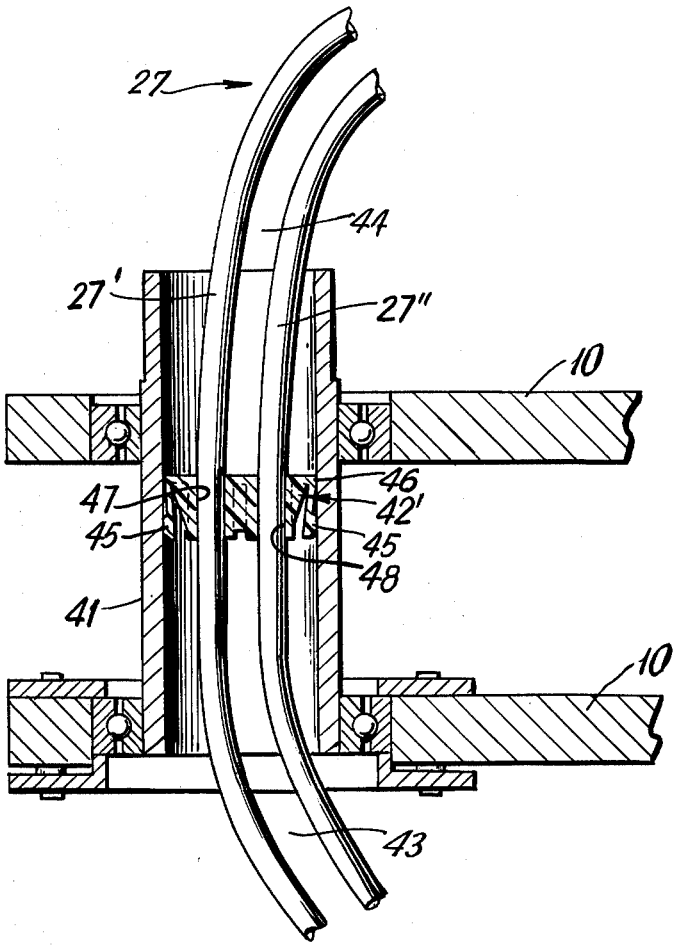
FIG. 8 is a sectional view of a preferred embodiment of a tube guide insert, in accordance with the present invention.
Figure 9:
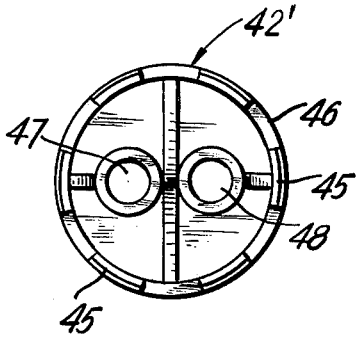
FIG. 9 is a plan view of a preferred embodiment of a tube guide insert, in accordance with the present invention.

A preferred embodiment of the tube guide insert is depicted in FIGS. 8 and 9. As shown therein, the tube guide insert 42' consists of a disc of rigid polymeric or other structural material into which a set of parallel channels or holes has been molded. The diameter of the tube guide insert 42' is determined by that of the tube guide 41 and the length is chosen to provide a uniform curvature to the rotating tubing loop 27 in order to minimize frictional contact in the peripheral segments 43, 44 of tubing loop 27. The channels 47, 48, one for each of the discrete tubes 27', 27'', are of a diameter substantially equal that of the tubing O.D., thereby facilitating a frictional fit. Preferably, the tube guide insert 42' is inserted into the tube guide 41 and secured by means of a press fit.

FIG. 9 illustrates, in more detail, the actual construction of the preferred embodiment of a tube guide insert 42', in accordance with the present invention. It consists of a serrated skirt with elements 45 perpendicular to the face of the disc 46, thereby ensuring that a snug fit between the tube guide insert 42' and the inner walls of the tube guide 41 is maintained. The two cylindrical channels 47, 48 perpendicular to the face of the disc 46 further ensure that the two discrete tubes 27', 27'' are maintained in the proper spaced-apart relationship.

It should be clear that the above description of preferred embodiments in no way limits the scope of the invention which is defined in the claims.

We claim as our invention:

1. A compensating rotor having, in combination:
- a frame assembly;
- a central vertical axis;
- means for causing the frame assembly to rotate about the central vertical axis at rotational speed w;
- a centrifugal processing container;
- means for causing the centrifugal processing container to rotate about the central vertical axis at rotational speed 2w;
- a stationary source of fluid supply;
- a flexible tubing loop for effecting the exchange of fluid between the rotating centrifugal processing container and the stationary source of fluid supply;
- a tube guide mounted on the rotating frame enclosing the peripheral segment of the tubing loop;
- a center spindle interfacing with the rotating centrifugal processing container enclosing the lower central segment of the tubing loop;
- a centrifuge cover enclosing the compensating rotor having an opening for routing the upper central segment of the tubing loop to the stationary source of fluid supply;

wherein the improvement comprises:
- means for constraining the lower central segment of the tubing loop in the region of the center spindle;
- means for separating and constraining the peripheral segment of the tubing loop within the tube guide; and
- means for constraining the upper central segment of the tubing loop in the region of the centrifuge cover.

2. A compensating rotor as recited in claim 1, wherein the means for constraining the lower central segment of the tubing loop in the region of the center spindle comprises a hollow smoothly contoured cylindrical fitting mounted within a bearing pressed into the center spindle; the means for separating and constraining the peripheral segment of the tubing loop within the tube guide comprises a cylindrical insert having at least one parallel channel extending the length of the insert; and the means for constraining the upper central segment of the tubing loop in the region of the centrifuge cover comprises a hollow smoothly contoured cylindrical fitting mounted within a bearing pressed into the centrifuge cover.

3. A compensating rotor having, in combination:
- a frame assembly;
- a central vertical axis;
- means for causing the frame assembly to rotate about the central vertical axis at rotational speed w;
- a centrifugal processing container;
- means for causing the centrifugal processing container to rotate about the central vertical axis at rotational speed 2w;
- a stationary source of fluid supply;
- a flexible tubing loop for effecting the exchange of fluid between the rotating centrifugal processing container and the stationary source of fluid supply;
- a tube guide mounted on the rotating frame enclosing the peripheral segment of the tubing loop;

wherein the improvement comprises:
- means for separating and constraining the peripheral segment of the tubing loop within the tube guide.

4. A compensating rotor as recited in claim 3, wherein the means for separating and constraining the peripheral segment of the tubing loop within the tube guide comprises a cylindrical insert having at least one parallel channel secured within the tube guide.

5. A compensating rotor as recited in claim 3, wherein the means for separating and constraining the peripheral segment of the tubing loop within the tube guide comprises a disc-like insert having at least one parallel channel secured within the tube guide.

6. A compensating rotor as recited in claim 5, wherein the disc-like insert further comprises a plurality of perpendicular elements positioned in a spaced-apart relationship about the perimeter of the body of the disc.

7. A compensating rotor as recited in claim 3 wherein the means for separating and constraining the peripheral segment of the tubing loop comprises a disc-like insert having at least one channel parallel to the tube guide having a diameter substantially equal that of the tubing outer diameter thereby facilitating a fictional fit.

8. A compensating rotor as recited in claim 3 wherein the means for separating and constraining the peripheral segment of the tubing loop comprises a disc-like insert having at least one channel parallel to the tube guide having a length selected to provide a uniform curvature to the tubing loop.

9. A compensating rotor as recited in claim 1 wherein the means for constraining the lower central segment of the tubing loop in the region of the center spindle comprises a fitting having a bore therethrough for receiving and constraining the tubing loop mounted on the center spindle wherein the bore's diameter incrementally decreases for a first selected distance along the longitudinal axis of the bore with the first selected distance starting at a first end of the fitting and the bore's diameter incrementally increases for a second selected distance along the longitudinal axis of the bore the second selected distance terminating at the other end of the fitting with the incremental increase of the diameter along the second selected distance being selected so that a smooth radius is defined along the interior and lower surfaces of the fitting; the means for separating and constraining the peripheral segment of the tubing loop within the tube guide comprises an insert having at least one channel parallel to the tube guide extending the length of the insert secured within the tube guide; and the means for constraining the upper central segment of the tubing loop in the region of the centrifuge cover comprises a fitting having a bore therethrough for receiving and constraining the tubing loop mounted on the centrifuge cover wherein the bore's diameter incrementally decreases for a first selected distance along the longitudinal axis of the bore with the first selected distance starting at a first end of the fitting and the bore's diameter incrementally increases for a second selected distance along the longitudinal axis of the bore the second selected distance terminating at the other end of the fitting with the incremental increase of the diameter along the second selected distance being selected so that a smooth radius is defined along the interior and lower surfaces of the fitting.

* * * * *